US006722750B2

(12) United States Patent
Chan

(10) Patent No.: US 6,722,750 B2
(45) Date of Patent: Apr. 20, 2004

(54) FOLDABLE CABINET

(75) Inventor: Alexander Guy Chan, Orinda, CA (US)

(73) Assignee: Portfolio Productions, Inc., Oakland, CA (US)

( * ) Notice: Subject to any disclaimer, the term of this patent is extended or adjusted under 35 U.S.C. 154(b) by 56 days.

(21) Appl. No.: 09/992,888

(22) Filed: Nov. 6, 2001

(65) Prior Publication Data

US 2003/0085640 A1 May 8, 2003

(51) Int. Cl.[7] ..... A47B 47/00
(52) U.S. Cl. ..... 312/258; 312/257.1
(58) Field of Search ..... 312/252.1, 258, 312/262, 263, 265.5, 313, 315; 108/99, 100, 166, 173, 179

(56) References Cited

U.S. PATENT DOCUMENTS

| | | | | | |
|---|---|---|---|---|---|
| 228,141 | A | * | 5/1880 | Tocci | 312/258 |
| 242,355 | A | | 5/1881 | Nicholas | |
| 442,664 | A | * | 12/1890 | Elsner | 312/262 |
| 1,174,846 | A | * | 3/1916 | Garland | 312/258 |
| 1,199,293 | A | | 9/1916 | Montgomery | |
| 1,202,205 | A | * | 10/1916 | Montgomery | 312/258 |
| 2,649,350 | A | * | 8/1953 | Backus et al. | 312/258 |
| 3,294,464 | A | * | 12/1966 | Lew | 312/258 |
| 3,425,763 | A | * | 2/1969 | De Lynn | 312/258 |
| 3,472,572 | A | * | 10/1969 | Himelreich | 312/258 |
| 3,583,781 | A | * | 6/1971 | Yamawaki et al. | 312/258 |
| 3,644,011 | A | * | 2/1972 | MacDonald | 312/258 |
| 3,752,552 | A | | 8/1973 | MacDonald | |
| 3,955,864 | A | | 5/1976 | MacDonald et al. | |
| 3,975,069 | A | * | 8/1976 | DeLucia | 312/258 |
| 4,482,195 | A | * | 11/1984 | Chapin | 312/258 |
| 5,882,098 | A | * | 3/1999 | Brown et al. | 312/258 |

FOREIGN PATENT DOCUMENTS

| | | | | |
|---|---|---|---|---|
| FR | 1371349 | * | 7/1964 | 312/258 |
| GB | 2187637 | * | 9/1987 | 312/258 |

* cited by examiner

*Primary Examiner*—Lanna Mai
*Assistant Examiner*—Hanh V. Tran
(74) *Attorney, Agent, or Firm*—Mark J. Spolyar

(57) ABSTRACT

Improved foldable cabinets. One implementation features a novel configuration providing a highly compact and efficient form when such cabinets are in a folded orientation. One implementation of the foldable cabinet includes a hinge assembly with mating cutout sections in the hinged members.

24 Claims, 14 Drawing Sheets

FOLDABLE CABINET

FIELD OF THE INVENTION

The present invention relates generally to folding cabinets and, more particularly, to folding cabinets adapted to fold into substantially flat configurations for shipping and storage, and to be readily opened and assembled with a minimum of effort.

BACKGROUND OF THE INVENTION

Foldable cabinets are known in the art. Indeed, an intended advantage of folding cabinets is that, in a folded state, they may be shipped more easily than non-folding or fully assembled cabinets, and then assembled with a minimum of tools and effort. U.S. Pat. No. 242,355 shows a folding wardrobe without shelves is adapted to be folded into a compact flat configuration so as to reduce storage space and shipping costs. U.S. Pat. No. 1,199,293 discloses a folding cabinet which incorporates hinged folding sides and hinged shelves for easy assembly. This folding cabinet, however, incorporates a very complex fabric back and folding top panel which renders the cabinet difficult to manufacture and expensive to sell. Moreover, the cabinet lacks a locking device to keep the shelf rigidly attached to the sidewall. U.S. Pats. No. 3,752,552 and 3,955,864 show folding cabinets in plastic molded construction featuring offset hinge points accommodating overlapping side panels.

While the folding cabinets of the prior art fulfill there respective objectives, the folding cabinet configurations of the prior art often sacrifice aesthetics relative to traditional, non-folding cabinets, to achieve their respective functions. Accordingly, a need exists in the art for folding cabinets that create the visual impression of a traditional, non-folding cabinet. Embodiments of the present invention substantially fulfill this need. In addition, other embodiments also feature a novel configuration that allow for highly compact and efficient forms when such cabinets are in a folded orientation.

SUMMARY OF THE INVENTION

The present invention provides improvements to foldable cabinets. In one embodiment, the present invention provides a novel offset hinge assembly allowing for a foldable cabinet that creates the visual impression of traditional, non-folding cabinets. In another embodiment, the present invention provides a novel configuration providing a highly compact and efficient form when such cabinets are in a folded orientation.

In one embodiment, the foldable cabinet comprises a front frame having side rails each attached to opposing side panels with hinges for quick and easy assembly with a minimum of parts. The front frame may include one or more hinged doors within the front frame. In one embodiment, at least one shelf is hinged between the side rails of the front frame to move between a horizontal position, when the cabinet is assembled, and a vertical position flat against the door(s), when the cabinet is in a folded orientation. The side panels, when folded out, extend backwards at a 90-degree angle to the front frame, and fold inwards towards each other to lie against the folded shelf when the cabinet is folded. A tab or cleat extending from the side panels engage pins extending from the shelves to support and lock the shelves in a horizontal orientation when the cabinet is assembled. In one embodiment, a back panel slides into opposing grooves extending vertically along the rear edges of the side panels to create a box-like assembly with an open top. In one embodiment, a top panel covers the top of the box-like assembly and connects to the cabinet with the use of locater pins and a locking mechanism to complete the cabinet assembly.

DESCRIPTION OF PREFERRED EMBODIMENT (S)

Figure 1:
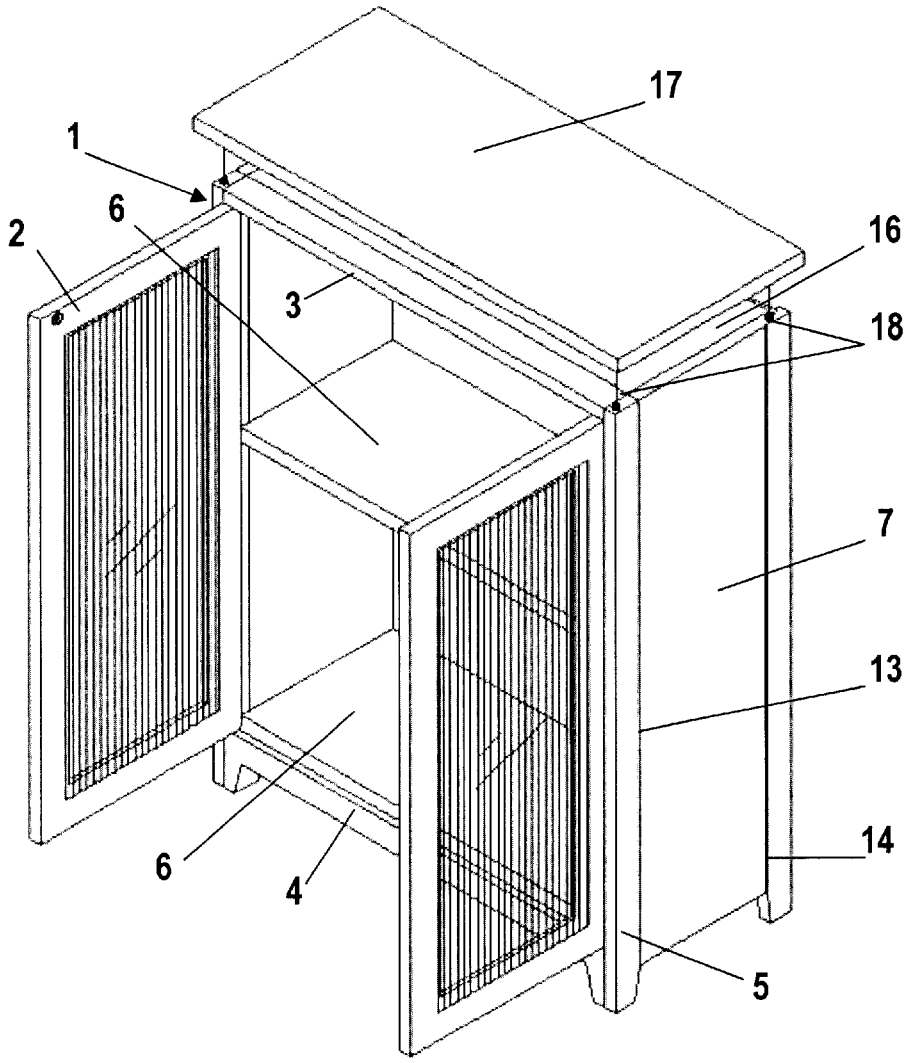
FIG. 1 is a perspective view of a cabinet according to one embodiment of the invention from the front view with the doors open and the top off.
Figure 2:
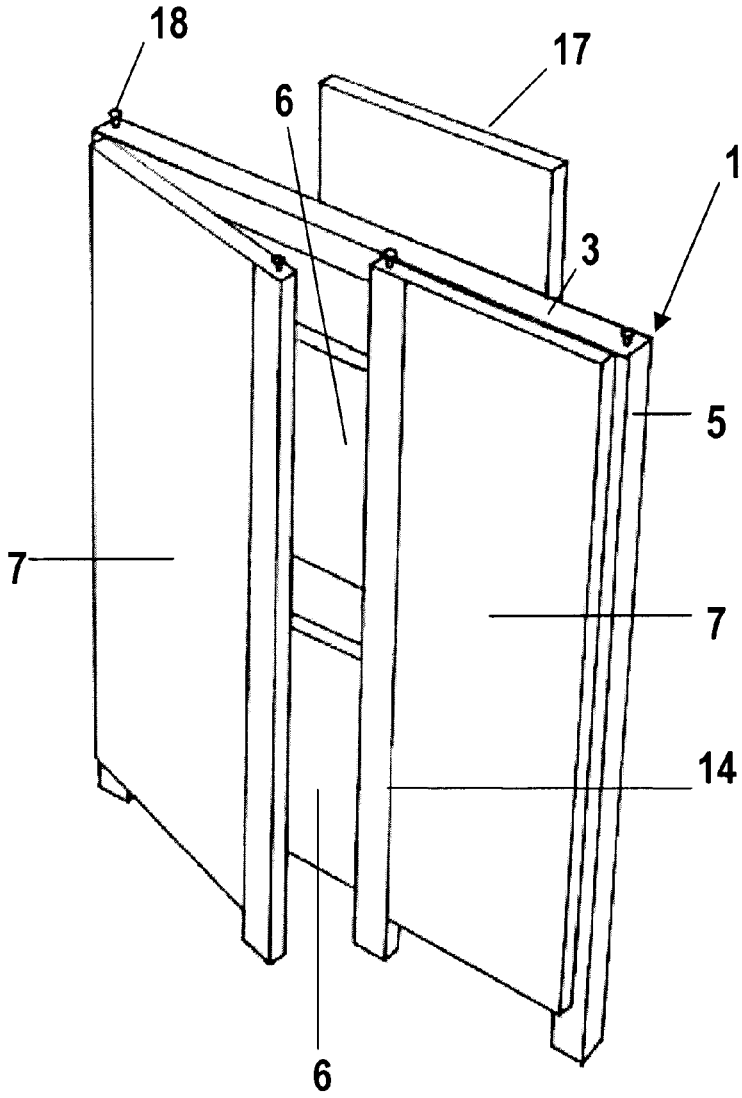
FIG. 2 is a perspective view of the cabinet when folded.

FIGS. 1–6 illustrate the configuration and assembly of a first embodiment of the present invention. FIG. 1 illustrates a cabinet that, in an assembled state, shows no sign that it is a folding cabinet. FIG. 2 shows the same cabinet in a folded state. The cabinet is generally oriented about a front structural frame 1 that holds one or more doors 2 along its front face. Front frame 1 comprises top rail 3, bottom rail 4 and two side rails 5. Side rails 5 of front frame 1 extend back beyond the thickness of doors 2 to provide space to attach and store one or more pivoting shelves 6. Shelves 6, in one embodiment, extend horizontally between side rails 5 and are pivotally connected at their front corners to the inward facing surfaces of the side rails 5 behind doors 2. Shelves 6 fold from a horizontal position when the cabinet is assembled to a vertical position laying flat against doors 2 when folded. Side panels 7 are connected to the back edge of each side rail 5 with hinges 45 and extend towards the rear of the cabinet at a 90-degree angle to front frame 1. Side panels 7 each fold 90 degrees inward to lie flat against the folded shelves 6 when the cabinet is in a disassembled and folded configuration.

Figure 3:
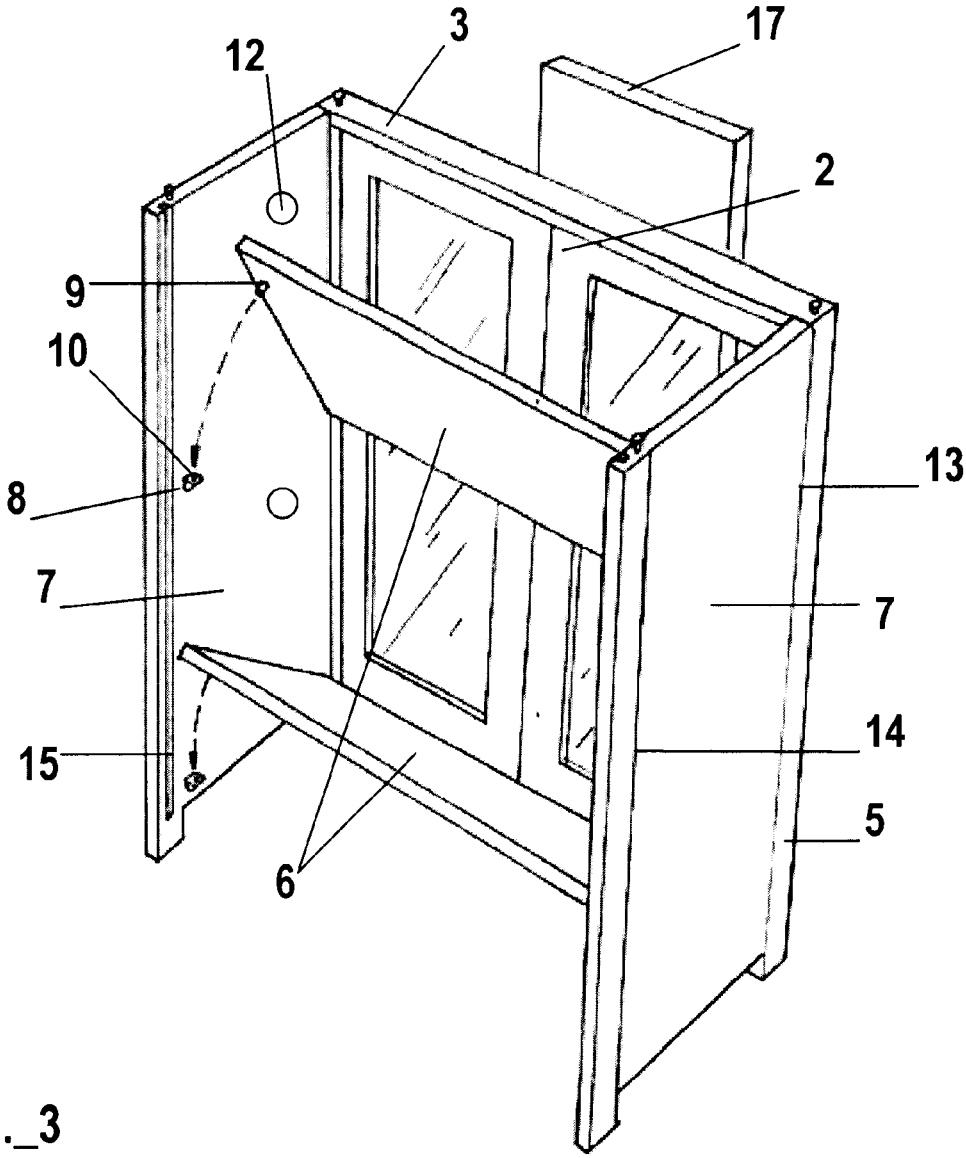
FIG. 3 is a perspective view illustrating assembly of the cabinet.
Figure 4:
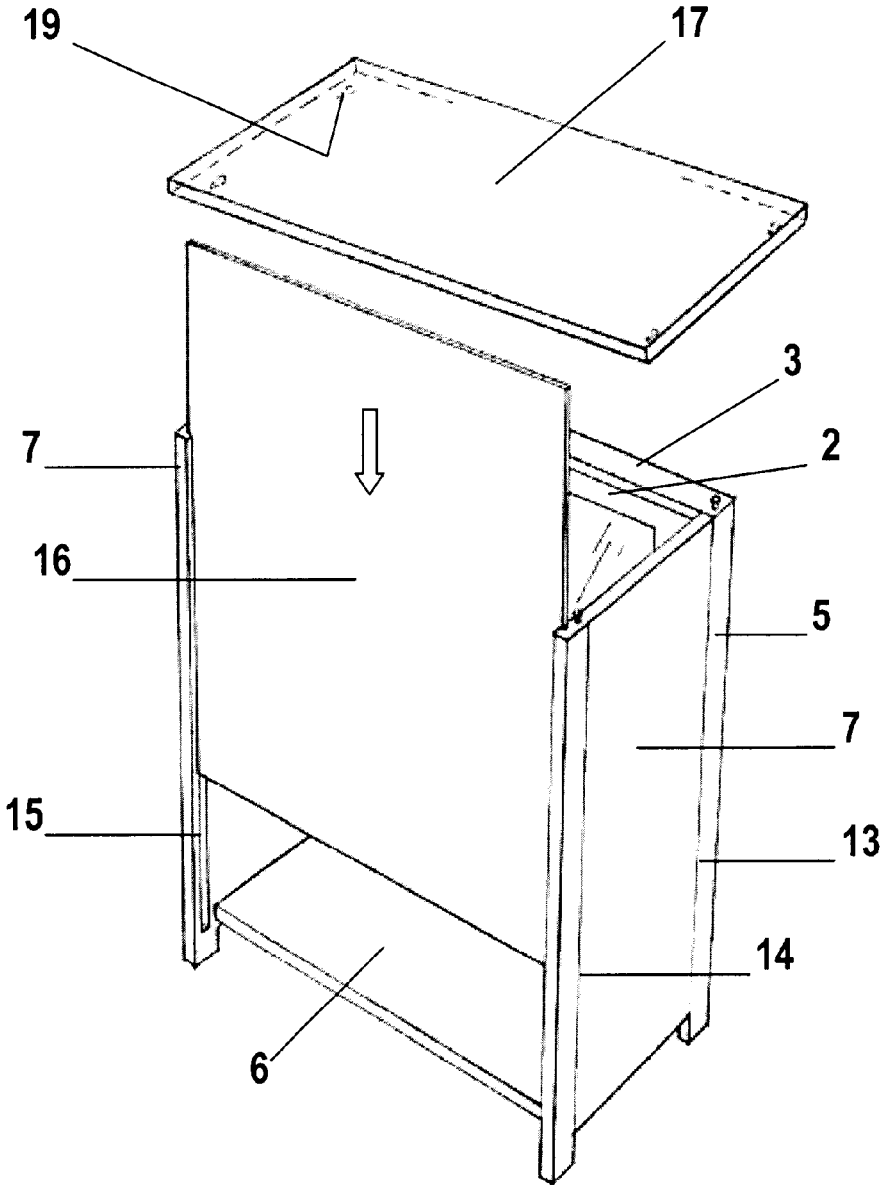
FIG. 4 is a perspective view further illustrating assembly of the cabinet.
Figure 5:
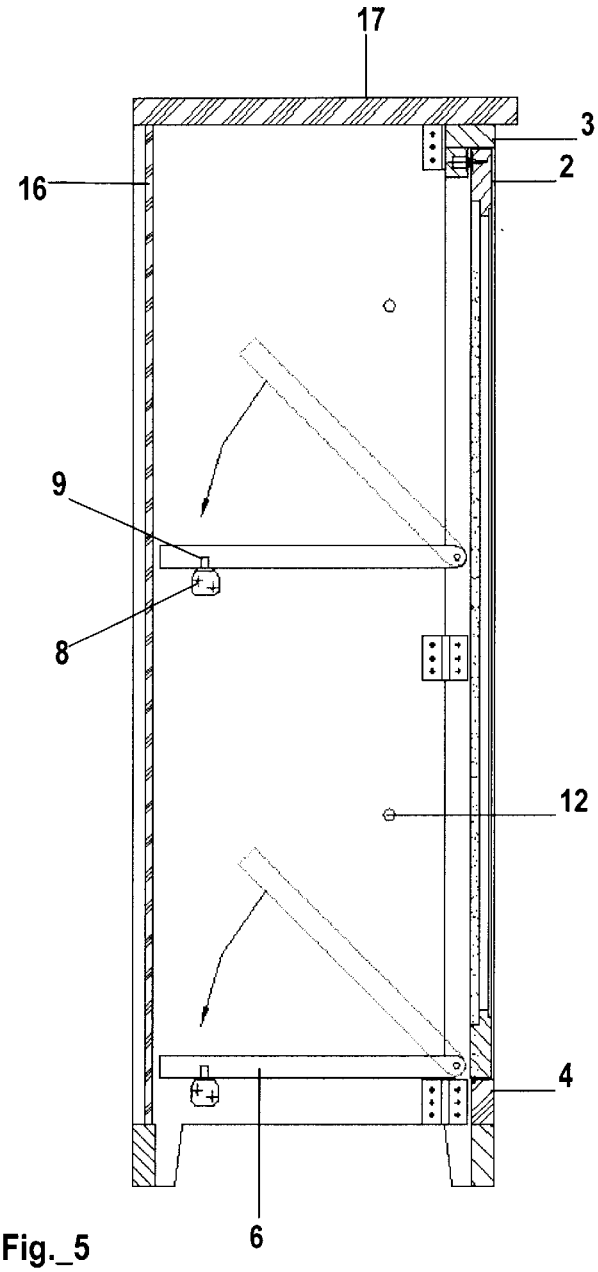
FIG. 5 is a sectional plan view of the cabinet in an assembled configuration.
Figure 6:
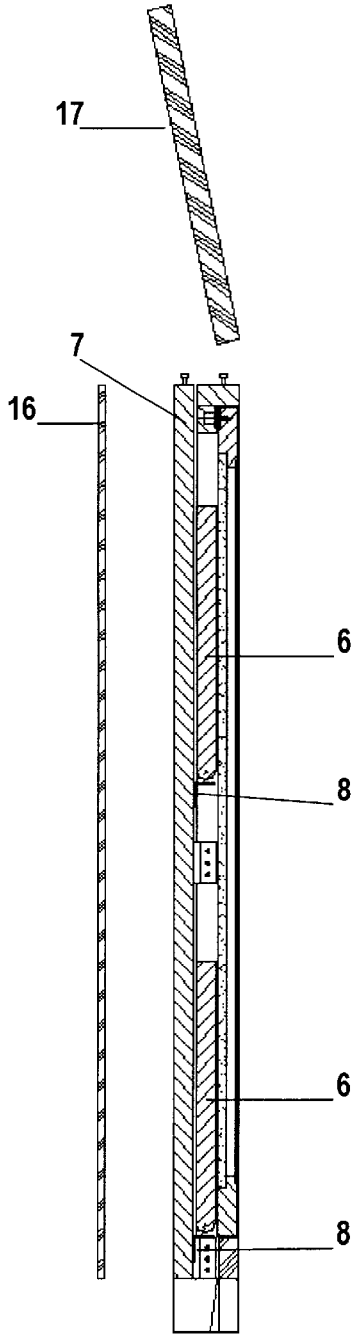
FIG. 6 is a sectional plan view of the cabinet in a folded configuration.
Figure 6A:
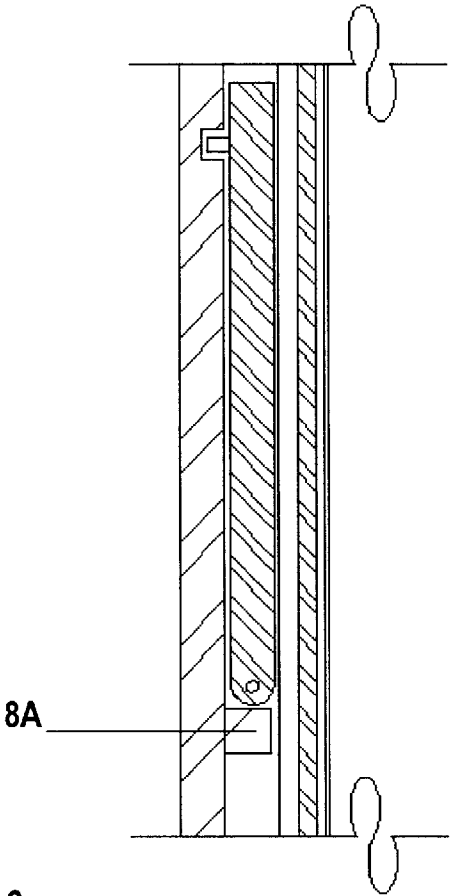
FIG. 6A is a sectional plan view illustrating the embodiment of FIG. 5A in a folded configuration.
Figure 5A:
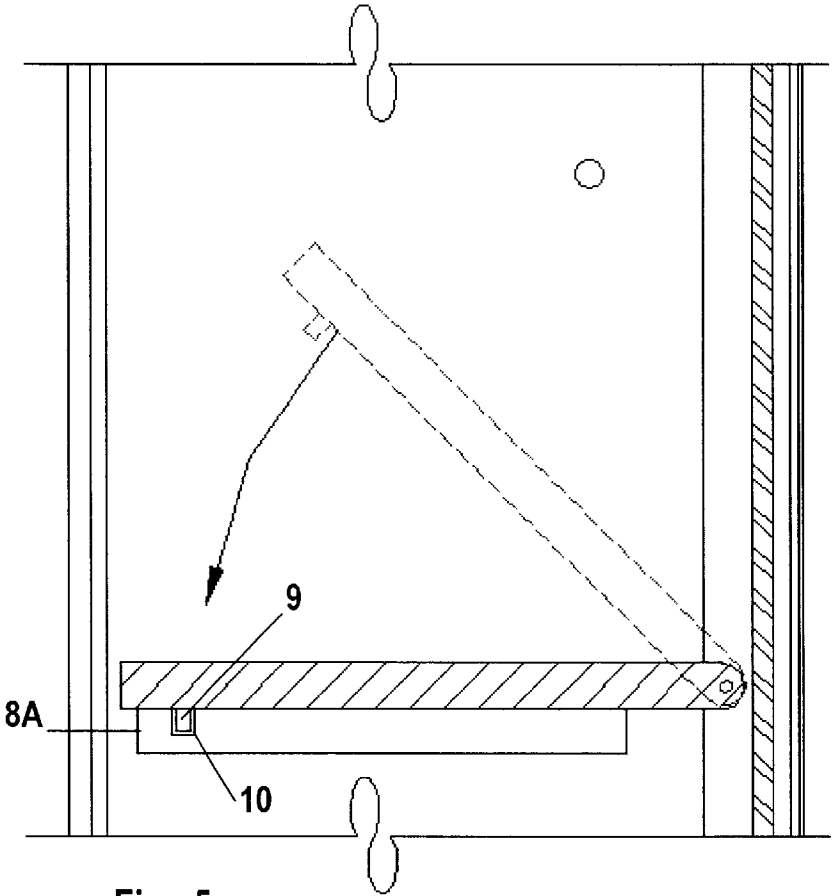
FIG. 5A is a sectional plan view illustrating an embodiment of the cabinet including a stretcher bar supporting the shelf
Figure 6B:
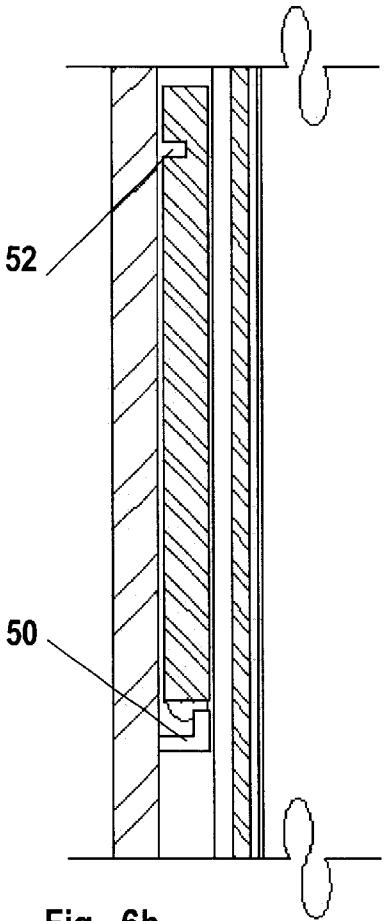
FIG. 6B is a sectional plan view illustrating the embodiment of FIG. 5B in a folded configuration.
Figure 7:
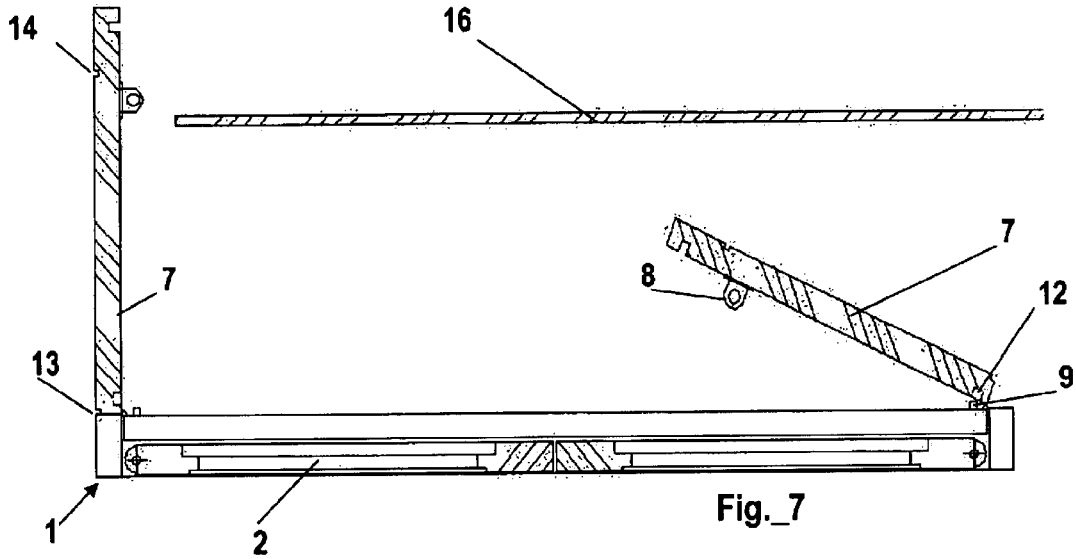
FIG. 7 is a top sectional plan view illustrating assembly of the cabinet.

Shelf 6, when in the horizontal position, rests on flat tabs 8 that protrude out from side panels 7 (See FIGS. 3 & 5). As FIG. 5A shows, in other embodiments, stretcher bars 8A with corresponding holes 10 are used to provide increased support to shelf 6. In one embodiment, side panels 7 and pivoting shelves 6 are interlocked by means of at least one pin 9 inserted into and extending from the bottom surface of shelf 6 along the edge adjacent to side panels 7. Pin 9 engages hole 10 in flat tab 8 extending out from side panel 7. Flat tab 8 (or stretcher bar 8A) is located at a height on each side panel 7 to allow tab 8 (or stretcher bar 8A) to slide under folded shelf 6 when the cabinet is folded (see FIGS. 6 & 6A). As FIG. 6 shows, in embodiments including more than one shelf, tabs 8 are positioned vertically to fit in the gap between the bottom edge of an upper shelf and the top edge of a lower shelf. As FIG. 7 shows, hole 12 partially drilled into side panel 7 allows pin 9 to insert into side panel 7, when the cabinet is folded, thereby allowing side panels 7 to fold flat against shelf 6. In another embodiment, pins 9 are removed from shelves 6 before folding to obviate the need for holes 12. This configuration allows for a cabinet assembly that, when folded for shipping or storage, is thinner than prior art foldable cabinets. Specifically, in its folded state, the placement of flat tabs 8 relative to shelves 6 allows side panels 7 to be folded directly against shelves 6. Shelves 6 in turn fold directly against front frame 1 to provide for a reduced profile.

Figure 5B:
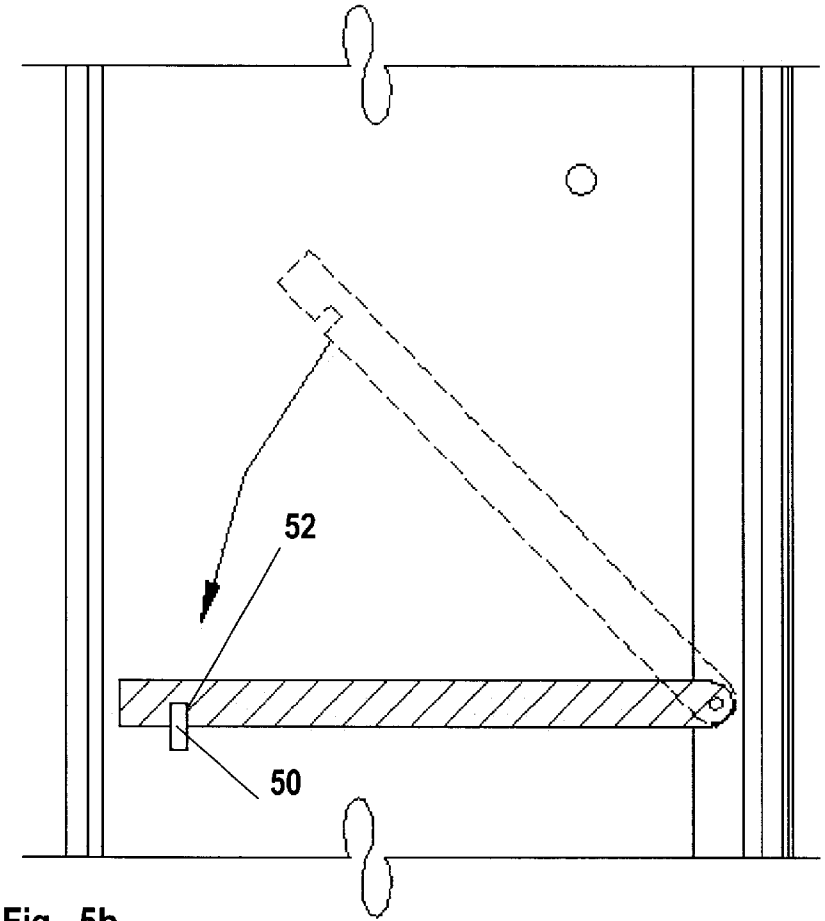
FIG. 5B is a sectional plan view illustrating an embodiment of the cabinet including an L-shaped pin extending from the side panel and engaging the shelf.
Figure 6C:
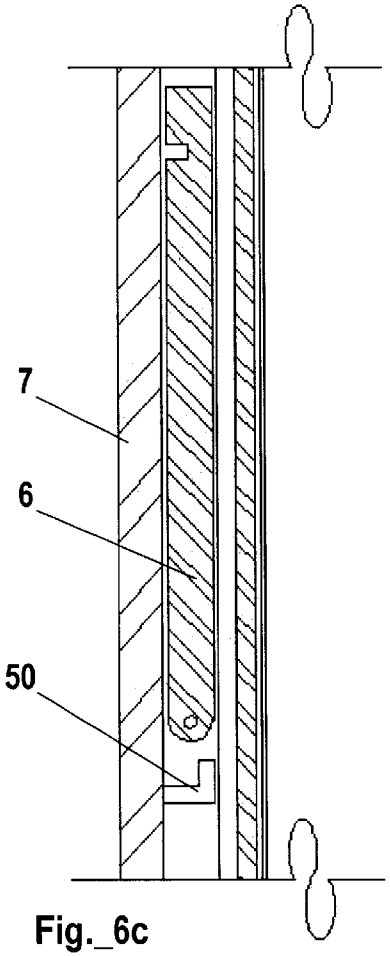
FIG. 6C is a sectional plan view illustrating the embodiment of FIG. 5C in a folded configuration.
Figure 5C:
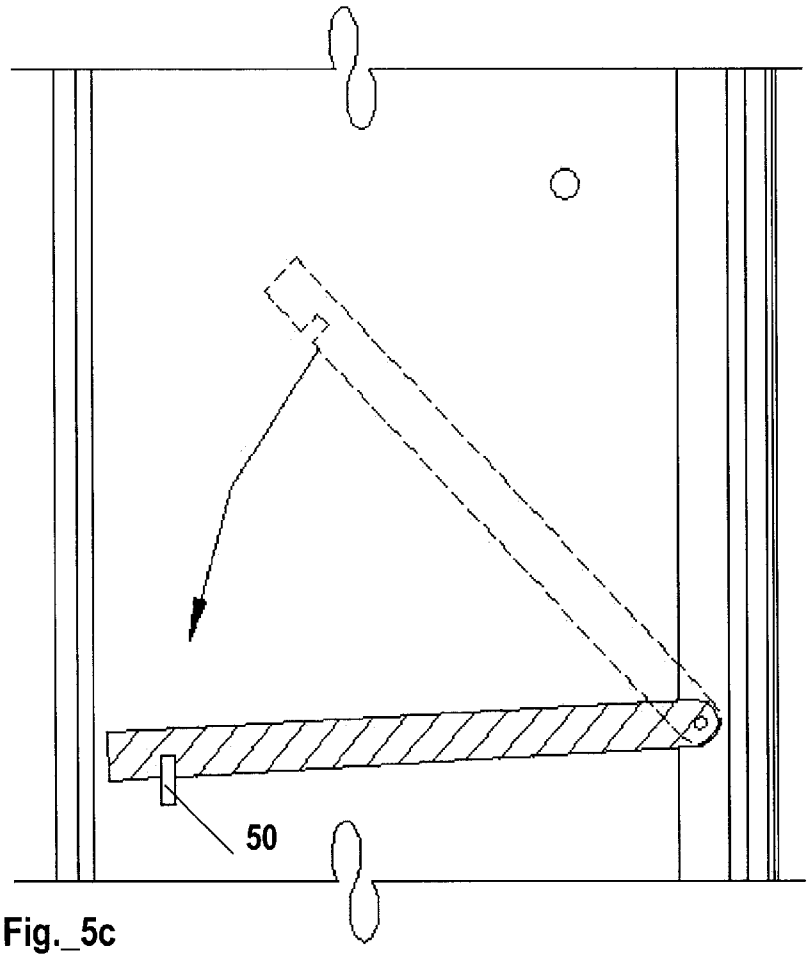
FIG. 5C is a sectional plan view illustrating an embodiment of the cabinet wherein the L-shaped pin is oriented to fit under the shelf when folded.
Figure 6D:
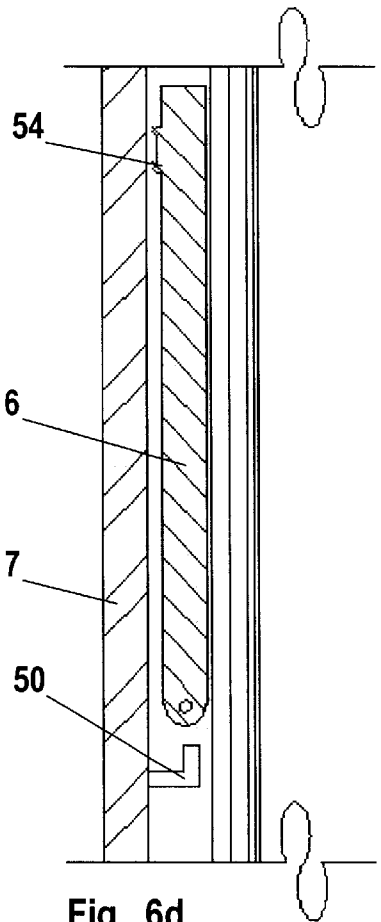
FIG. 6D is a sectional plan view illustrating the embodiment of FIG. 5D in a folded configuration.
Figure 5D:
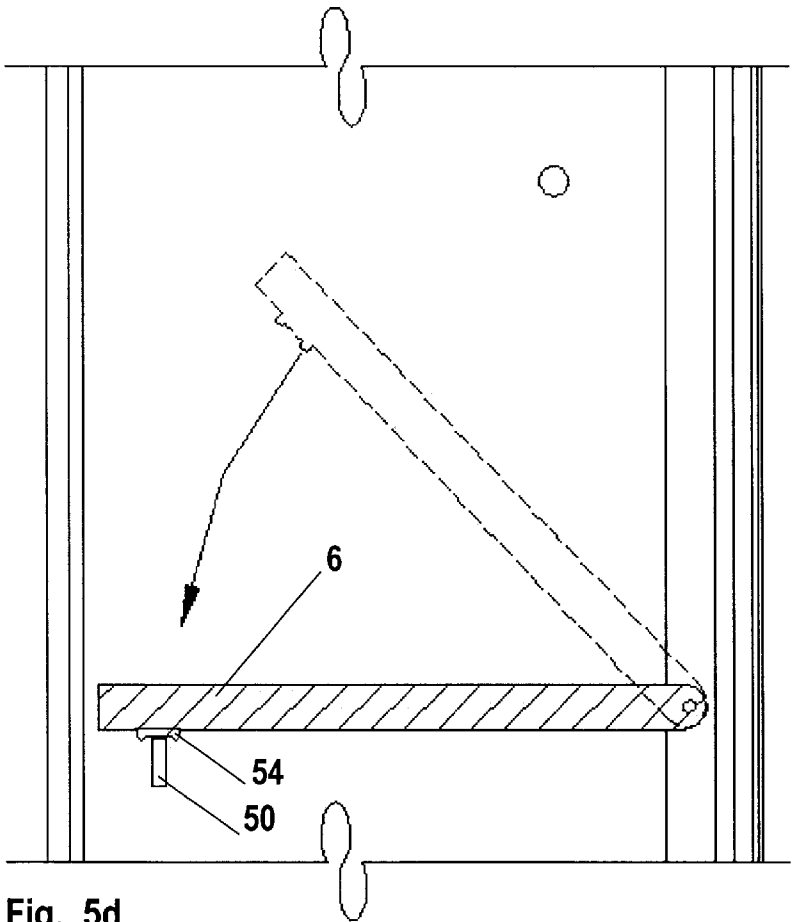
FIG. 5D is a sectional plan view illustrating an extension ring attached to the bottom of the shelf and engaging the L-shaped pin.

FIGS. 5B, 5C and 5D illustrate alternative means for supporting shelf 6 and interlocking shelf 6 and side panels 7 to create a suitably rigid structure. As FIG. 5B shows, shelf 6 can be locked to side panel 7 with the combination of L-shipped pin 50 extending from side panel 7, as shown, and a corresponding hole 52 in shelf 6. However, in the embodiment of FIG. 5B, shelf 6 must include properly placed cutouts to allow room for L-shaped pins 50 when the cabinet is in a folded configuration. Alternatively, as FIG. 5C shows, L-shaped pin 50 may be placed vertically along side panel 7 such that it fits under shelf 6 without a cutout section. While this may be acceptable for some applications, shelf 6 does not rest horizontally when the cabinet is assembled. Accordingly, as FIG. 5D provides, shelf 6 may include an extension ring 54 that engages L-shaped pin 50, thereby allowing L-shaped pin to fit under shelf 6 when the cabinet is folded and allowing shelf 6 to lay horizontally when the cabinet is assembled.

In one embodiment, the inward-facing surface of each side panel 7 has a groove 15 cut along the rearward facing edge. Back panel 16 inserts into grooves 15 to enclose the cabinet on all four sides. The interlocking of side panels 7 to shelves 6 with the pin 9 and tab 8 system ensures that hinged side panels 7 do not open too far and allow back panel 16 to fall out. In a preferred embodiment, back panel 16 fits tightly into grooves 15 to provide lateral stiffness to the assembled cabinet.

To complete the cabinet assembly, top panel 17, in one embodiment, connects to the rest of the cabinet with a screw 18 and keyhole 19 joint. The user aligns the screws 18 with the keyholes 19 and pushes top panel 17 to one side thereby locking it in place. Top panel 17 further operates to prevent back panel 16 from falling out. As one can see from this description, this embodiment of the cabinet allows for assembly without the use of tools.

Figure 7A:
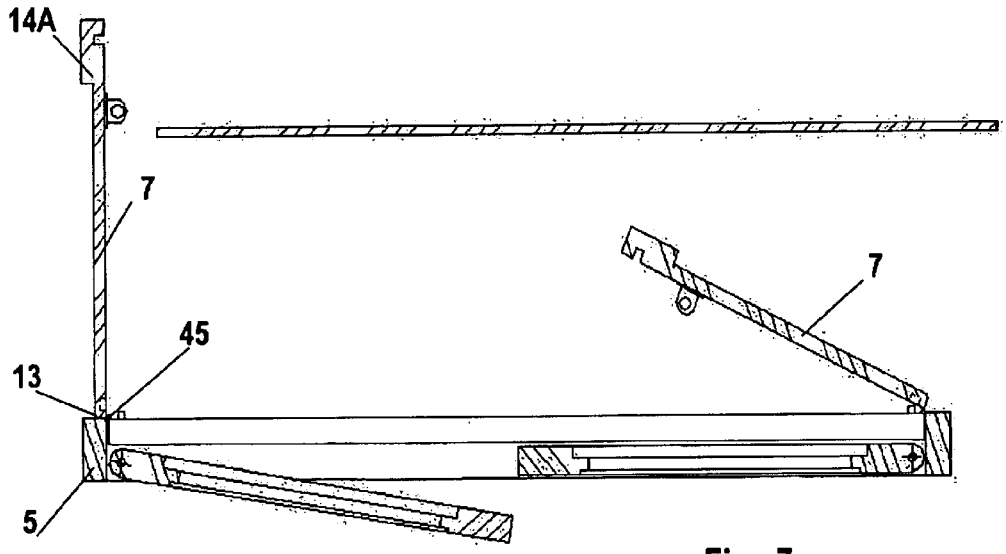
FIG. 7A is a sectional plan view illustrating a matching groove line created by the change in surface plane of a side panel of an embodiment of the folding cabinet.

One embodiment of the present invention is a folding cabinet that, when assembled, has the appearance of a traditional, fully-assembled cabinet. The folding joint between front frame 1 and side panel 7 creates a visible groove line 13 on the side of cabinet. To obfuscate the visual impression of groove line 13, a second matching groove line 14 extends along the rearward edge of side panel 7 to give the appearance of legs on the cabinet and to make the overall appearance symmetrical. Matching groove line 14, in one embodiment, is created with a saw cut or a V-groove in the appropriate orientation. As FIG. 7 shows, in one embodiment, a saw cut or V-groove is also cut along groove line 13 to match the appearance of groove line 14. P In addition, FIG. 7A illustrates another embodiment that obfuscates the visual impression of groove line 13 by a change in the surface plane of side panel 7. As FIG. 7A shows, hinge 45 connecting side panel 7 to side rail 5 is offset to achieve a first change in the plane surface of the cabinet and to give the appearance that side rail 5 is a leg of the cabinet. Extending vertically along its rear edge, side panel 7 includes a raised surface feature at 14A to match side rail 5 and give the appearance of a matching cabinet leg. In a preferred form, the width of the raised surface feature 14A matches the width of side rail 5. In one embodiment, side panel 7 may further include a cutout section along the bottom edge thereof and up to line 14A to enhance the impression that the cabinet includes legs.

Figure 8:
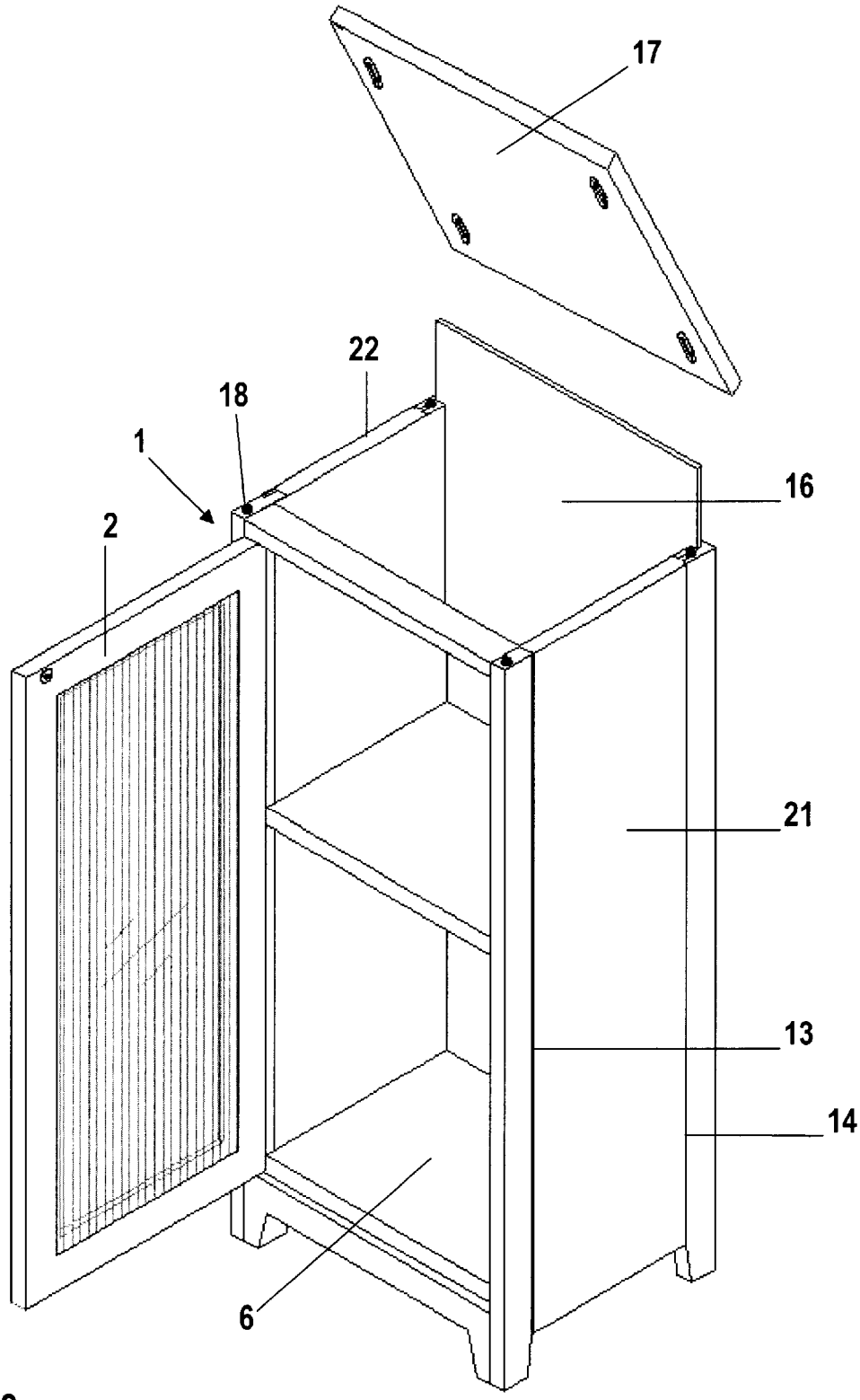
FIG. 8 is a perspective view of a narrow cabinet with the door open and the top off.
Figure 9:
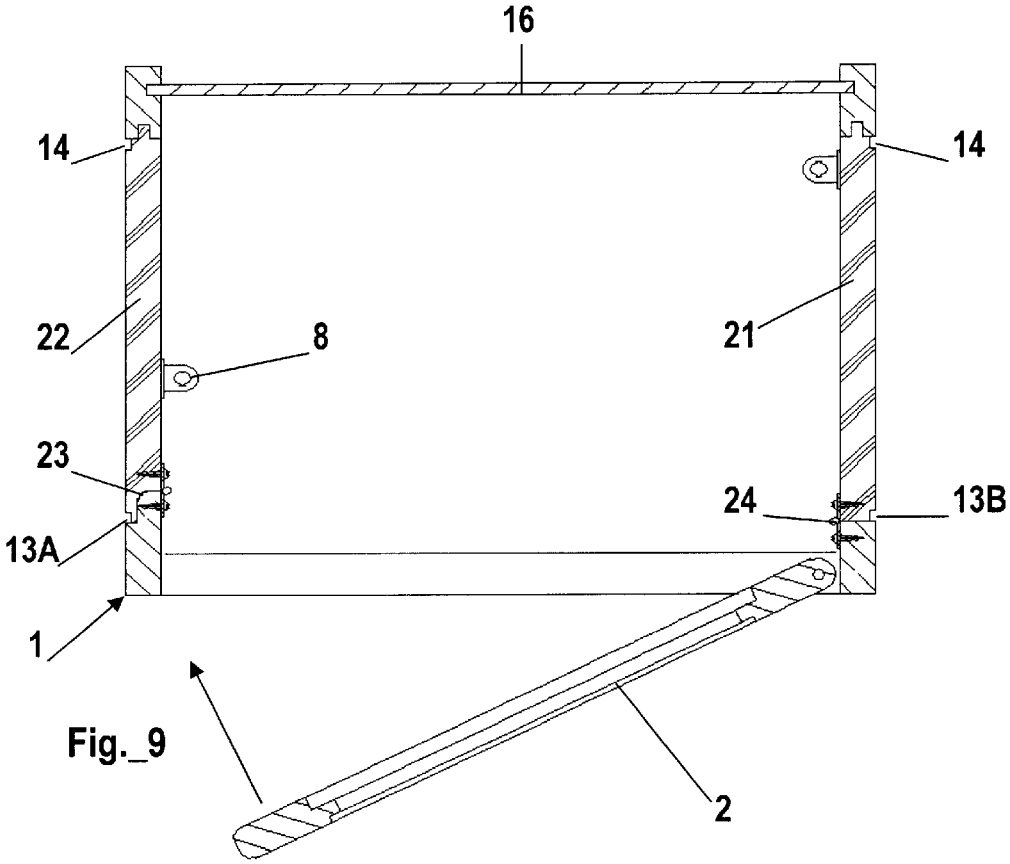
FIG. 9 is a top plan section view of the narrow cabinet in an assembled state.
Figure 10:
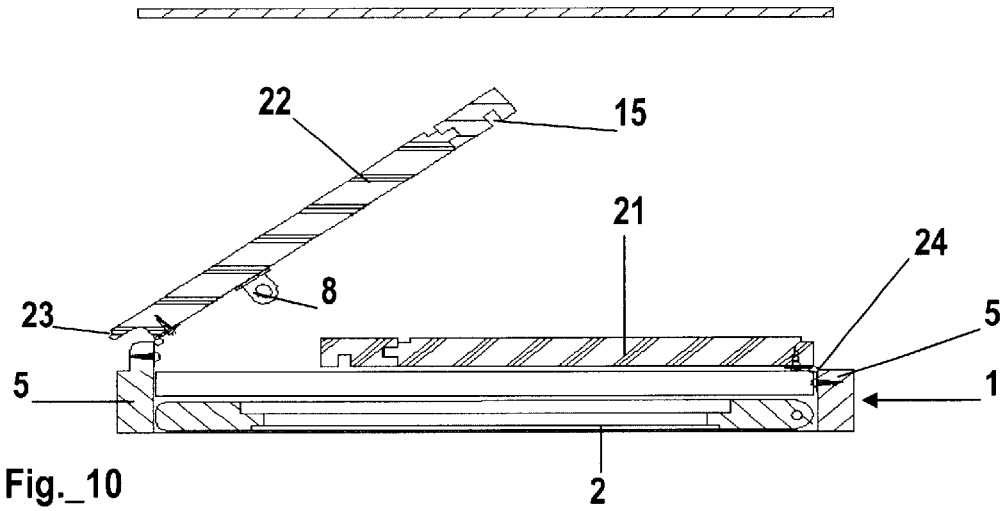
FIG. 10 is a top plan section view of the narrow cabinet in a folded configuration.

FIGS. 8–10 illustrate the configuration and assembly of a second folding cabinet having a narrower overall configuration and one door 2. In a second embodiment, front frame 1 is narrower such that side panels 21, 22 overlap when the cabinet is in a folded state. Such a configuration requires different or offset hinge points on the two sides relative to front frame 1. To create the offset hinge points, the folding cabinets of the prior art feature side rails of different widths to create the required offset and allow the side panels to overlap; however, this configuration readily reveals that the cabinet is a folding cabinet and furthermore is not aesthetically appealing, since the visible grooves between the front frame and the respective side rails are offset from one another (i.e., not spaced evenly from the front frame).

To overcome this problem, embodiments of the present invention feature a special joint configuration (see FIG. 10, #23 and FIG. 11A, #23A) to achieve the objective of providing a folding cabinet that when assembled, includes evenly spaced groove lines and, therefore, creates the visual impression of a traditional, non-folding cabinet. As FIG. 9 illustrates, two different types of hinge joints are provided. First side panel 21 and the side rail of front frame 1 hinge together at a simple butt joint 24. To create the desired visual impression, a stepped hinge joint is created where the front edge of second side panel extends beyond the hinge point of the joint 23 and abuts against the side rail of front frame 1. In one form, the front edge of second side panel 22 includes a cutout on its inner edge, while the rear edge of the side rail includes a mating cutout portion on its outer edge. One bracket of hinge or joint 23 attaches to the inner surface of the second side rail, while the other bracket attaches to the second side panel above the cutout. In this configuration, the outward appearance of joint lines 13B and 13A between first 21 and second 22 side panels, respectively, and front frame 1 match, while still allowing for the requisite offset of the pivot points of the hinges to allow side panels 21, 22 to overlap when the cabinet is in a folded configuration (see FIG. 10). As described above, matching groove lines 14 extending vertically along the opposite edges of side panels 7 can be used to give the appearance that the cabinet has legs.

Figure 11:
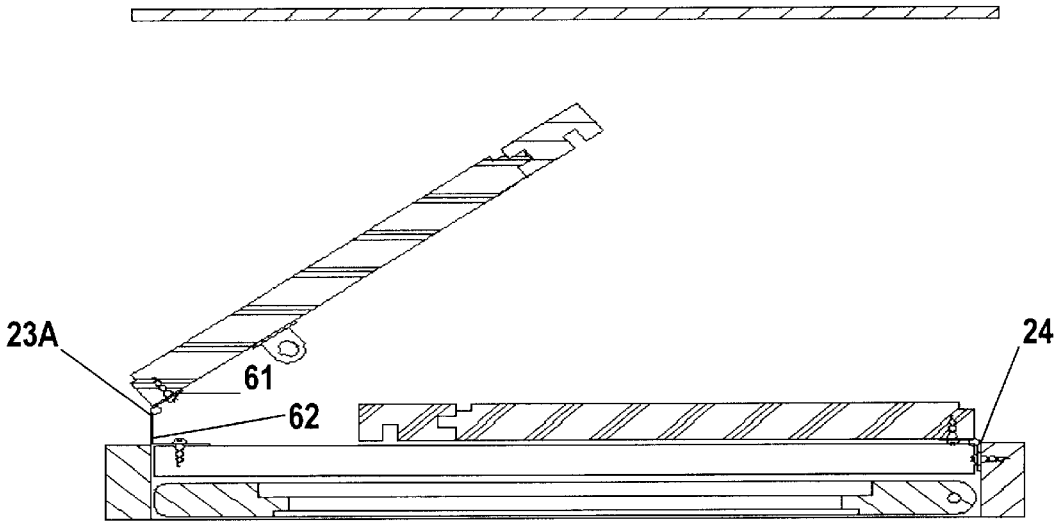
FIG. 11 is a top plan view illustrating a stepped hinge according to an embodiment of the present invention.
Figure 11A:
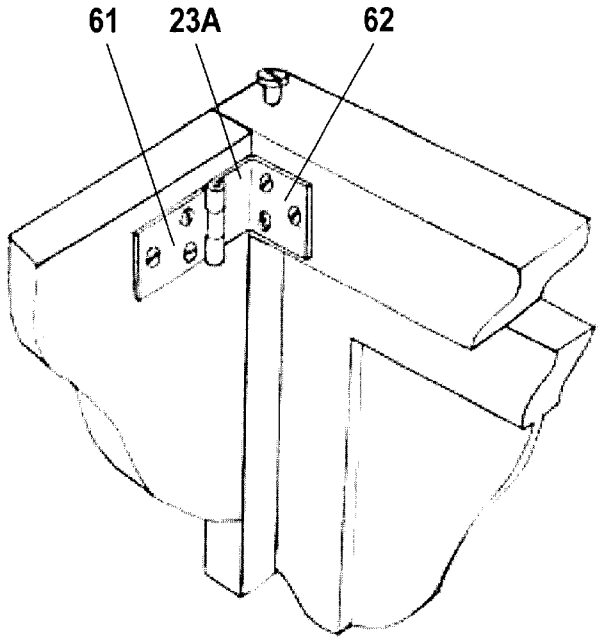
FIG. 11A is a perspective sectional view illustrating an offset hinge assembly according to one embodiment of the present invention.

In addition, FIGS. 11 and 11A illustrate an alternate stepped hinge configuration 23A which creates the same visual impression and function as the embodiment shown in FIGS. 7 to 9. As FIGS. 10A and 10B show, side panel 21 is the same length and configuration as the opposing side panel. The stepped configuration of hinge 23A, however, creates the requisite offset between the axis of hinge 23A and the opposing hinge 24. That is, hinge 23A includes a first bracket member 61 attached to folding side panel 22 and a second L-shaped bracket member 62 attached to front frame 1. As FIGS. 10A and 10B show, the extended portion of the L-shaped bracket provides for the requisite offset to allow side panels 21, 22 to overlap, while still creating the desired visual impression.

In addition, while the cabinet illustrated in the various Figures, include shelves 6 hinged to side rails 5. Other embodiments of the cabinet may include shelves that slide into slots extending along the side panels. The profiles of the slots in the side panels may be straight or keyed, such as a dove-tail groove, to match corresponding edge features of the shelves.

Figure 12:
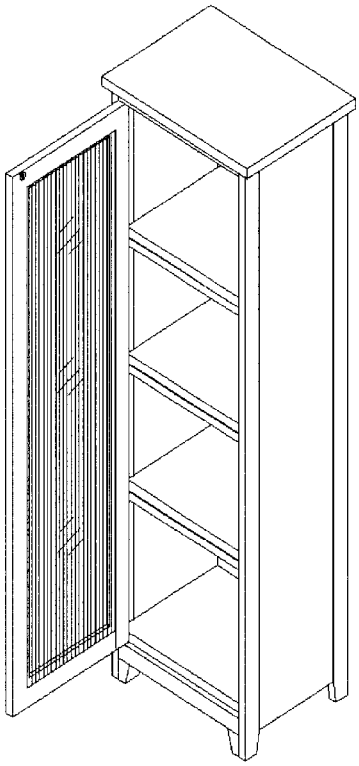
FIG. 12 is a perspective view of a tall single door cabinet with multiple interior shelves.
Figure 14:
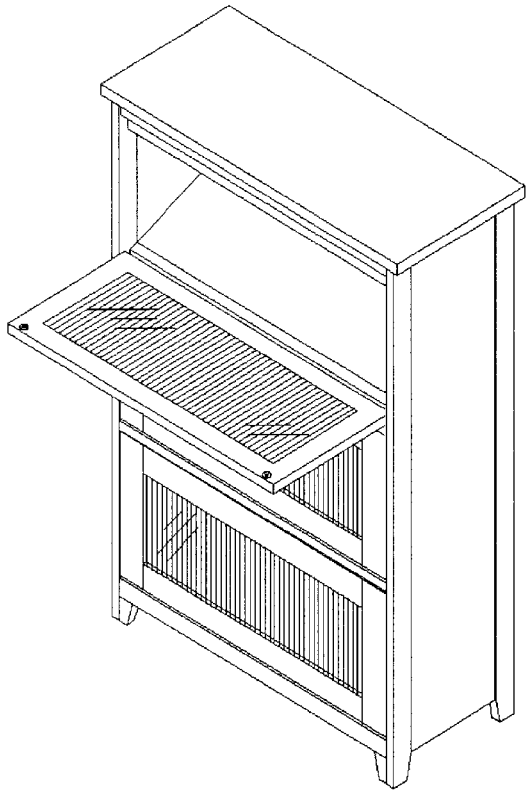
FIG. 14 is a perspective view of a three door cabinet with multiple interior shelves.
Figure 13:
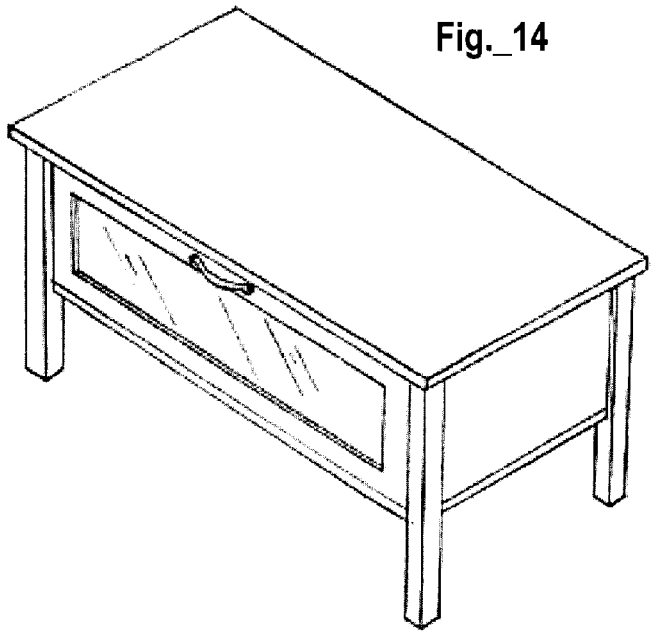
FIG. 13 is a perspective view of a single door cabinet configured to function as a coffee table.

FIGS. 12, 13 and 14 show other embodiments of the present invention. FIG. 12 is a perspective view of a tall single door cabinet with multiple interior shelves. FIG. 13 is a perspective view of a single door cabinet configured to function as a coffee table. FIG. 14 is a perspective view of a three door cabinet with multiple interior shelves. These three variations show the limitless variety of styles and applications for the present invention. Accordingly, although the present invention has been described with reference to specific embodiments, various other embodiments are possible without departing from the scope of the present invention. Other embodiments of the present invention will be apparent to one of ordinary skill in the art. It is, therefore, intended that the claims set forth below not be limited to the embodiments described above.

What is claimed is:

1. A folding cabinet comprising:

a front frame comprising a top rail, a bottom rail, a first side rail and a second side rail;

at least one door hinged to and mounted within the front frame;

a first upper shelf and a lower second shelf, each pivotally mounted between the first and second side rails of the front frame behind the hinged door, wherein the first upper shelf and the lower second shelf are movable from a horizontal position to a vertical position;

a first side panel hinged to the rear edge of the first side rail, the first side panel movable from a position extending back from the front frame at a 90 degree angle when the cabinet is assembled to a position lying fiat against the surfaces of the first upper shell and the lower second shell when the cabinet is in a folded orientation, a second side panel hinged to the rear edge of the second side rail, the second side panel movable from a position extending back from the front frame at a 90 degree angle when the cabinet is assembled to a position lying fiat against the surfaces of the first upper shelf and the lower second shelf when the cabinet is in a folded orientation, a removable rear panel attached to the first and second side panels to create a box-like assembly with an open top, a removable top panel attached to and covering the top of the box-like assembly;

wherein a first support member extends from the inner face of the first side panel to support the first upper shelf when the cabinet is assembled, wherein a second support member extends from the inner face of the second side panel to support the first upper shell when the cabinet is assembled, wherein the first and second support members lie in the gap between the bottom edge of the first upper shelf and the top edge of the second lower shelf, when the first and second lower shelves are in a vertically folded in a vertical orientation, to allow the first and second side panels to fold against the shelves.

2. The folding cabinet of claim 1 wherein the first and second support members are first and second respective tabs.

3. The folding cabinet of claim 1 wherein the first and second support members are first and second respective stretcher bars.

4. The folding cabinet of claim 2 wherein the bottom surface of the shelf includes a first engagement feature to engage the first support member when the shelf is folded out and supported by the first support member, wherein the bottom surface of the shelf includes a second engagement feature to engage the second support member when the shelf is folded out and supported by the second support member, wherein the first and second tabs each include a hole, and wherein the first and second engagement features are pins extending from the bottom surface of the shelf and engaging the respective holes in the tabs when the shelf is in a horizontal orientation.

5. The folding cabinet of claim 3 wherein the first and second stretcher bars each include a hole, and wherein the first and second engagement features are pins extending from the bottom surface of the shelf and engaging the respective holes in the stretcher bars when the shelf is in a horizontal orientation.

6. The folding cabinet of claim 1 wherein the first and second support members are first and second L-shaped pins, and wherein the bottom surface of the shelf includes corresponding holes engaging the first and second L-shaped pins when the shelf is folded out in a horizontal position.

7. The folding cabinet of claim 1 wherein the first and second support members are first and second L-shaped pins, and wherein the bottom surface of the shelf includes corresponding extension rings extending therefrom and engaging the first and second L-shaped pins when the shell is folded out in a horizontal position.

8. The folding cabinet of claim 1 wherein the first side panel includes a groove extending along the inward facing back edge of the first side panel, wherein the second side panel includes a matching groove extending along the inner facing back edge of the second side panel, and wherein the rear panel is slidably mounted in the respective grooves of the first and second side panels.

9. The folding cabinet of claim 1 wherein the top panel, is removably attached to the box-like assembly with at least one pin and keyhole connection.

10. The folding cabinet of claim 1 wherein the first side panel includes a groove extending vertically along the back edge thereof to match the groove between the first side rail and the front edge of the first side panel.

11. The folding cabinet of claim 10 wherein the second panel includes a groove extending vertically along the back edge thereof to match the groove between the second side rail and the front edge of the second side panel.

12. The folding cabinet of claim 1 wherein the outer surface of the first side panel is offset to the inside of the outer surface of the first side rail when the first side panel is folded out; and wherein the outer surface of the first side panel includes a raised surface feature extending vertically along the rear edge thereof.

13. The folding cabinet of claim 12 wherein the width of the raised surface feature on the first side panel matches the width of the first side panel.

14. The folding cabinet of claim 12 wherein the outer surface of the second side panel is offset to the inside of the outer surface of the second side rail when the first second panel is folded out; and wherein the outer surface of the second side panel includes a raised surface feature extending vertically along the rear edge thereof.

15. The folding cabinet of claim 14 wherein the width of the raised surface feature on the second side panel matches the width of the second side panel.

16. A folding cabinet comprising:

a front frame comprising a top rail, a bottom rail, a first side rail and a second side rail;

at least one door hinged to and mounted within the front frame;

a shelf pivotally mounted between the first and second side rails of the front frame behind the hinged door, wherein the shelf is movable front a horizontal position to a vertical position lying flat against the hinged door;

a first hinge pivotally connecting a first side panel to the rear edge of the first side rail, the first side panel movable from a position extending back from the front frame at a 90 degree angle when the cabinet is assembled to a position lying flat against the surface of the pivoting shelf when the cabinet is in a folded orientation, a second hinge pivotally connecting a second side panel to the rear edge of the second side rail, wherein the second hinge is offset from the first hinge such that the second side panel is movable from a position extending back from the front frame at a 90 degree angle when the cabinet is assembled to a position lying flat against the surface of the first side panel when the cabinet is in a folded orientation, wherein the second panel extends beyond the hinge point of the second hinge to abut against the rear edge of the second rail when the second panel is folded out;

a removable rear panel attached to the first and second side panels to create a box-like assembly with an open top, a removable top panel attached to and covering the top of the box-like assembly;

wherein a first support member extends from the inner face of the first side panel to support the shelf when the cabinet is assembled, wherein a second support member extends from the inner face of the second side panel to support the shelf when the cabinet is assembled, wherein the bottom surface of the shelf includes a first engagement feature to engage the first support member when the shelf is folded out and supported by the first support member, wherein the bottom surface of the shelf includes a second engagement feature to engage the second support member when the shelf is folded out and supported by the second support member, and wherein the first support member fits under the shell, when folded in a vertical orientation, to allow the first side panels to fold against the shelf and wherein the first side panel includes a recessed region corresponding to the first engagement feature extending from the shelf to allow the first side panel to fold flat against the shelf.

17. The folding cabinet of claim 16 wherein the second hinge comprises a first bracket member hinged to a second L-shaped bracket member, wherein the L-shaped bracket member is attached to the front frame, and wherein the first bracket member attaches to the second side panel.

18. The folding cabinet of claim 16 wherein the first side panel includes a groove extending along the inward facing back edge of the first side panel, wherein the second side panel includes a matching groove extending along the inner facing back edge of the second side panel, and wherein the rear panel is slidably mounted in the respective grooves of the first and second side panels.

19. The folding cabinet of claim 16 wherein the cabinet comprises a first upper shelf and a lower second shelf, each pivotally mounted to the first and second side rails, and wherein the first support member of the first side panel corresponding to the upper shelf fits in the gap between the bottom edge of the first upper shelf and the top edge of the second lower shelf, when the cabinet is in a folded orientation.

20. The folding cabinet of claim 16 wherein the top panel is removably attached to the box-like assembly with at least one pin and keyhole connection.

21. The folding cabinet of claim 16 the first side panel includes a groove extending vertically along the back edge thereof to match the groove between the first side rail and the front edge of the first side panel.

22. The folding cabinet of claim 21 wherein the second panel includes a groove extending vertically along the back edge thereof to match the groove between the second side rail and the front edge of the second side panel.

23. A folding cabinet comprising:

a front frame comprising a top rail, a bottom rail, a first side rail and a second side rail;

at least one door hinged to and mounted within the front frame;

a shelf pivotally mounted between the first and second side rails of the front frame behind the hinged door, wherein the shelf is movable from a horizontal position to a vertical position;

a first hinge pivotally connecting a first side panel to the rear edge of the first side rail, the first side panel movable from a position extending back from the front frame at a 90 degree angle when the cabinet is assembled to a position lying fiat against the inner surface of the front frame when the cabinet is in a folded orientation, a second hinge pivotally connecting a second side panel to the rear edge of the second side rail, wherein the second hinge is offset from the first hinge such that the second side panel is movable from a position extending back from the front frame at a 90 degree angle when the cabinet is assembled to a position tying flat against the surface of the first side panel when the cabinet is in a folded orientation, wherein the rear edge of the second side rail has a cutout in the outer portion thereof; wherein the second side panel has a mating cutout section in the inner portion thereof; and wherein the second hinge comprises a first bracket pivotally attached to a second bracket, wherein the first bracket attaches to the second side rail, and wherein the second bracket attaches to the second side panel proximal to the cutout therein;

a removable rear panel attached to the first and second side panels to create a box-like assembly with an open top, and a removable top panel attached to and covering the top of the box-like assembly.

24. A folding cabinet comprising:

a front frame comprising a top rail, a bottom rail, a first side rail and a second side rail;

at least one door hinged to and mounted within the front frame;

a shelf pivotally mounted between the first and second side rails of the front frame behind the hinged door, wherein the shelf is movable from a horizontal position to a vertical position;

a first side panel hinged to the rear edge of the first side rail, the first side panel movable from a position extending back from the front frame at a 90 degree angle when the cabinet is assembled to a position lying flat against the surface of said shelf when the cabinet is in a folded orientation, a second side panel hinged to the rear edge of the second side rail, the second side panel movable from a position extending back from the front frame at a 90 degree angle when the cabinet is assembled to a position lying flat against the surface of said shelf when the cabinet is in a folded orientation, a removable rear panel attached to the first and second side panels to create a box-like assembly with an open top, a removable top panel attached to and covering the top of the box-like assembly;

wherein a first support member extends from the inner face the first side panel to support the shelf when the cabinet is assembled, wherein a second support member extends from the inner face the second side panel to support the shelf when the cabinet is assembled, wherein the bottom surface of the shelf includes a first engagement feature to engage the first support member when the shelf is folded out and supported by the first support member, wherein the bottom surface of the shelf includes a second engagement feature to engage the second support member when the shelf is folded out and supported by the second support member, and wherein the first and second side panels include first and second recessed regions corresponding to the first and second engagement features extending from the shelf to allow the first and second side panels to fold flat against the shelf.

* * * * *

UNITED STATES PATENT AND TRADEMARK OFFICE

CERTIFICATE OF CORRECTION

PATENT NO. : 6,722,750 B2
DATED : April 20, 2004
INVENTOR(S) : Alexander Guy Chan It is certified that error appears in the above-identified patent and that said Letters Patent is hereby corrected as shown below:

Column 6,
Lines 6 and 13, replace "fiat" with -- flat --.
Lines 7, 8, 26 and 66, replace "shell" with -- shelf --.
Lines 30-31, delete "in a vertical" after "in a vertically folded."

Column 7,
Line 8, delete "panel," and insert -- panel --.
Line 44, replace "front" with -- from --.

Column 8,
Line 17, replace "shell" with -- shelf --.

Column 9,
Line 3, replace "fiat" with -- flat --.
Line 12, replace "tying" with -- lying --.

Signed and Sealed this

Sixth Day of July, 2004

JON W. DUDAS
*Acting Director of the United States Patent and Trademark Office*